US007370564B2

(12) United States Patent
Hennes

(10) Patent No.: US 7,370,564 B2
(45) Date of Patent: May 13, 2008

(54) CUTTING DEVICE AND TRANSPORTING ROLLER FOR WEBS OF MATERIAL

(75) Inventor: Jochen Hennes, Frankfurt (DE)

(73) Assignee: Kiefel Extrusion GmbH, Worms (DE)

( * ) Notice: Subject to any disclaimer, the term of this patent is extended or adjusted under 35 U.S.C. 154(b) by 60 days.

(21) Appl. No.: 11/100,825

(22) Filed: Apr. 7, 2005

(65) Prior Publication Data

US 2005/0223865 A1 Oct. 13, 2005

(30) Foreign Application Priority Data

Apr. 8, 2004 (DE) ..... 10 2004 017 471

(51) Int. Cl.
*B26D 5/20* (2006.01)
*B65H 35/06* (2006.01)

(52) U.S. Cl. ..... 83/353; 83/487; 83/614; 83/734; 83/821

(58) Field of Classification Search ..... 83/353, 83/355, 628, 631, 56, 428, 436.75, 483, 485, 83/487, 488, 578, 614, 636, 694, 733, 734, 83/821
See application file for complete search history.

(56) References Cited

U.S. PATENT DOCUMENTS

| | | | | |
|---|---|---|---|---|
| 1,555,391 | A * | 9/1925 | Surfus | 162/285 |
| 1,967,486 | A * | 7/1934 | Vennewitz | 83/353 |
| 2,278,029 | A | 3/1942 | Walsh et al. | |
| 2,794,488 | A | 6/1957 | Fritzinger | |
| 3,958,473 | A * | 5/1976 | Lenk | 83/98 |
| 4,273,014 | A | 6/1981 | Edling | |
| 4,368,051 | A * | 1/1983 | Lehmacher | 493/11 |
| 4,398,903 | A * | 8/1983 | Lehmacher | 493/197 |
| 4,679,474 | A * | 7/1987 | Lambrecht | 83/171 |
| 5,813,305 | A | 9/1998 | Miazga et al. | |
| 6,003,421 | A | 12/1999 | Milich | |
| 6,190,297 | B1 | 2/2001 | Croft | |
| 2002/0069741 | A1 * | 6/2002 | Paris | 83/614 |

FOREIGN PATENT DOCUMENTS

| | | | |
|---|---|---|---|
| DE | 1 912 639 | | 12/1970 |
| DE | 29 21 067 | | 11/1979 |
| DE | 93 03 547 | | 5/1993 |
| JP | 60-178159 | * | 9/1985 |
| JP | 06127764 | | 5/1994 |
| JP | 06218691 | | 8/1994 |

OTHER PUBLICATIONS

Office Action dated Mar. 9, 2005 for the underlying German Application No. 10 2004 017 471.
Search Report dated May 23, 2005 for the corresponding European Application No. 05 00 6155.

* cited by examiner

*Primary Examiner*—Clark F. Dexter
(74) *Attorney, Agent, or Firm*—Cohen Pontani Lieberman & Pavane LLP

(57) ABSTRACT

The transporting roller, which serves for transporting a web of material which is wound up onto a winding shaft, is provided with a cutting device, which comprises a cutter and a cutter holder. The transporting roller has a groove, in which the cutter is guided. A catching device permits the introduction of the cutter into the groove. The groove is inclined with respect to an axially parallel generatrix, so that the web of material is cut off at an oblique angle.

6 Claims, 6 Drawing Sheets

CUTTING DEVICE AND TRANSPORTING ROLLER FOR WEBS OF MATERIAL

BACKGROUND OF THE INVENTION

1. Field of the Invention

The invention relates to a transporting roller for webs of material with a cutting device for the web of material provided outside the transporting roller.

2. Description of the Related Art

For carrying out a cutting operation which takes place outside the transporting roller, a known transporting roller of this type is provided with a deflecting roller, which lifts the web of material off the transporting roller in order that the cutter, which can be moved from one edge of the roller to the opposite edge of the roller, does not damage the transporting roller. Lifting the web of material off the transporting roller by means of a deflecting roller can cause variations in tension in the web of material, with an adverse influence on the winding result. Furthermore, the lifting-off can in this case cause the web of material to run out laterally, which likewise has a considerable adverse influence on the quality of the wound roll. Turning over of the web of material after cutting likewise cannot always be ensured.

SUMMARY OF THE INVENTION

The object of the invention is to avoid lifting the web of material off the transporting roller during the cutting operation and in this way improve the quality of the wound roll considerably.

According to the invention, the cutting device has at least one cutter which, during the cutting operation, is guided in a groove of the transporting roller in such a way that it can move in the longitudinal direction of the roller. The groove runs at an angle in relation to an axially parallel generatrix of the transporting roller, and by the cutter movement is controllable in dependence on the circumferential speed of the transporting roller.

On the basis of this configuration, it is no longer necessary for the web of material to be lifted off the transporting roller for cutting it, whereby the disadvantages explained at the beginning are avoided and the quality of the wound roll is improved considerably. It was previously only possible to avoid lifting-off from the transporting roller with cutting devices arranged in the interior of the transporting roller, the arrangement of which however requires significantly greater technical expenditure than is the case with a cutting device outside the transporting roller.

In an advantageous configuration of the invention it is provided that, if a single cutter is used, the groove runs from one side edge of the transporting roller to the opposite edge. This produces a particularly simple configuration, which also permits simple control of the cutter movement.

In this case, the included angle which the groove forms with the axially parallel generatrix can be constant or variable over the length of the groove.

According to a further advantageous configuration of the invention, for the driving of the cutter, it may be coupled to the transporting roller drive by means of a gear mechanism.

Instead of this mechanical coupling, it may also be provided that the drive of the cutter comprises an electric actuator, which is coupled to an actuator of the transporting roller drive by means of a control device.

A particularly simple configuration consists in that the drive of the cutter takes place by the edge of the groove in the manner of a motion-transmitting screw thread, and that a catching device for the cutter is provided at the beginning of the groove.

As from a certain angle of pitch of the groove with respect to the axially parallel generatrix, the cutter is displaced in the groove by the rotational movement of the roller without requiring a separate drive. It is merely necessary for the intended cutting operation to bring the cutter into the region of the device, in order to be able to introduce the cutter into the groove.

If, instead of an obliquely angled cut edge of the web of material, a pointed cut edge is desired, in order to obtain a more uniform beginning of the roll and thereby at the same time also increase the cutting speed, it is provided in a further configuration that the transporting roller has two crossing grooves and that two cutters that are movable in opposite directions are arranged.

This essentially produces a V-shaped arrangement of the grooves, which results in a pointed end of the cut web of material, and consequently easy winding up, whereby a roll without an oblique linear edge, and consequently a roll which is largely free from imbalance, is created. The essentially V-shaped form of the end of the web of material thereby created has an exactly cut point, since, with two cutters which cross each other, they pass through the crossing point at different times, which results in an exactly guided cut, even at the point of the cut-off web of material.

Depending on the desired form of the cut end of the web of material, the crossing point of the two grooves may be at the same distance from the edges of the transporting roller or at different distances.

According to a further configuration of the invention, at least two portions of the crossing grooves can run in each case to a side edge of the transporting roller. This means that, after passing through the crossing point, the cutters are removed from the grooves. It is also possible, however, that all the portions of the crossing grooves run to the side edges, whereby a continuous cutting movement of the respective cutters from one side edge to the opposite side edge is obtained.

The grooves may run at the same angle in relation to the axially parallel generatrix or else at different angles in relation to this generatrix, depending on which cutting shape is desired.

If, in a further configuration of the invention, the cutters are guided independently of each other, it is possible that they can be driven in an advantageous way at the same speed or at different speeds. Different speeds will be chosen if the cut of the two cutters is to end at the same time, so that the cutter starting later is driven more quickly. The control must always ensure, however, that the cutters pass through the crossing point at different times.

The object set out at the beginning can also be achieved on the basis of a transporting roller of the type specified at the beginning by the cutting device having a cutter which is movable essentially perpendicularly in relation to the web of material, toward it and away from it again, in the manner of a hacking device, which enters a groove provided in the transporting roller while simultaneously cutting through the entire width of the web of material.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
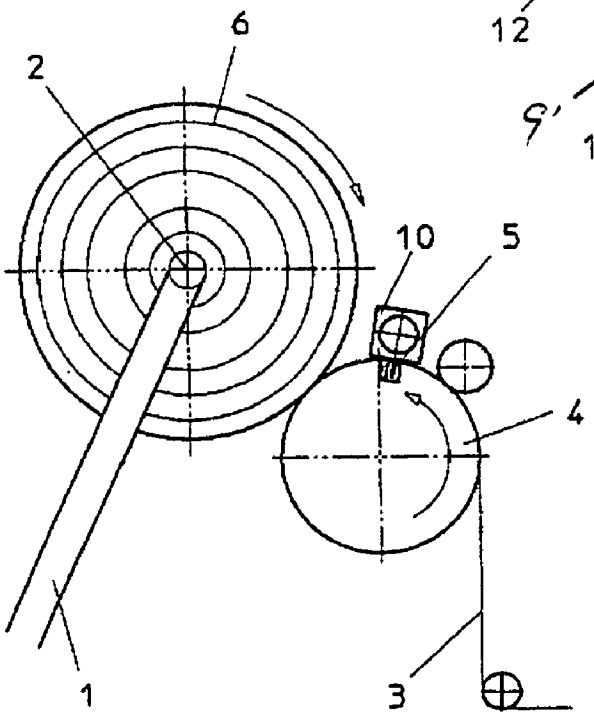
FIG. 1 shows a side view of a transporting roller in connection with a roll of a web of material.
Figure 3:
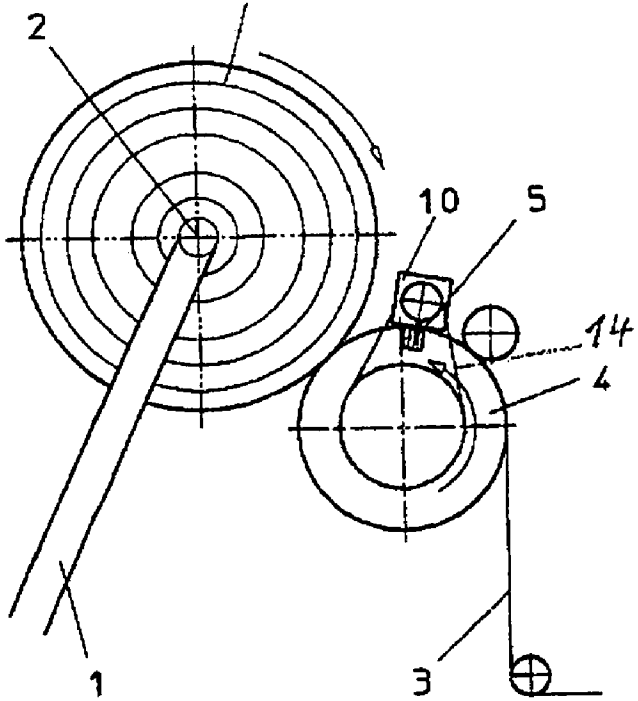
FIG. 3 shows a side view, corresponding to FIG. 1, of a further embodiment of a transporting roller.
Figure 5:
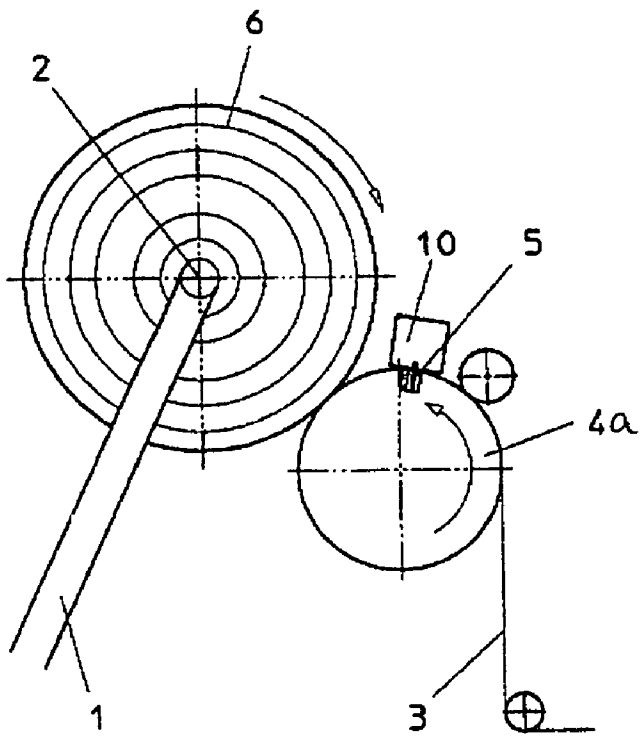
FIG. 5 shows a representation corresponding to FIGS. 1 and 3 of a third embodiment of a transporting roller.

As can be seen from FIGS. 1, 3 and 5, a winding shaft 2, on which a roll 6 of a web of material 3 is wound up, is rotatably mounted on a carrying arm 1. The web of material 3 runs over a transporting roller 4, which is in constant contact with the roll 6.

Figure 2:
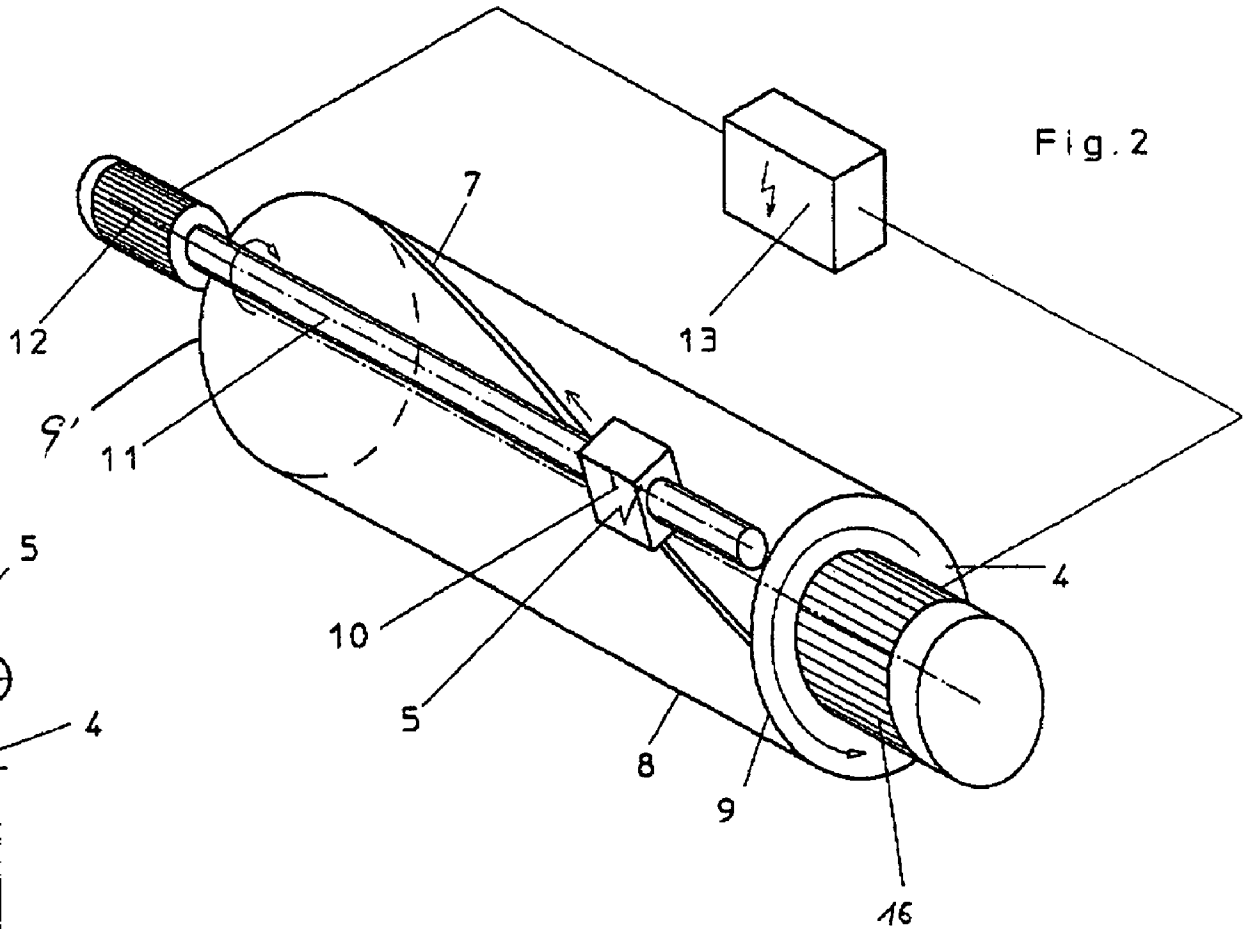
FIG. 2 shows a diagrammatic representation of the transporting roller on an enlarged scale.
Figure 4:
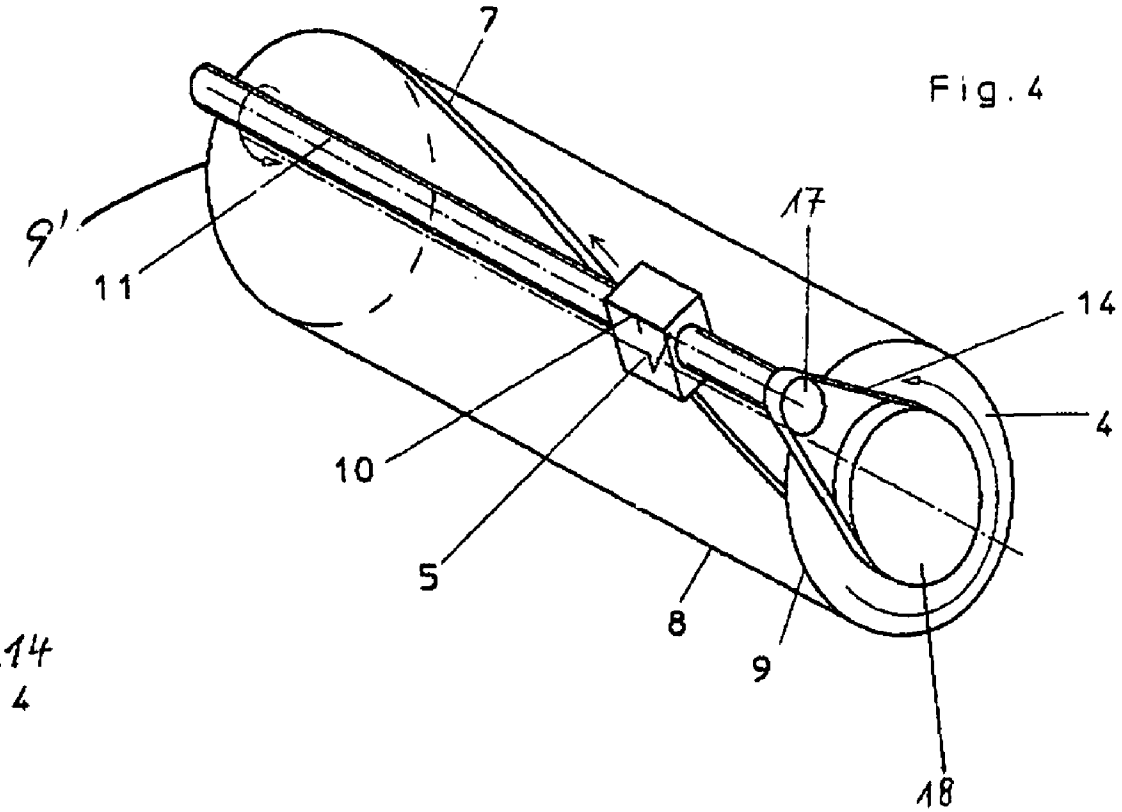
FIG. 4 shows the transporting roller from FIG. 3 in a diagrammatic representation on an enlarged scale.
Figure 6:
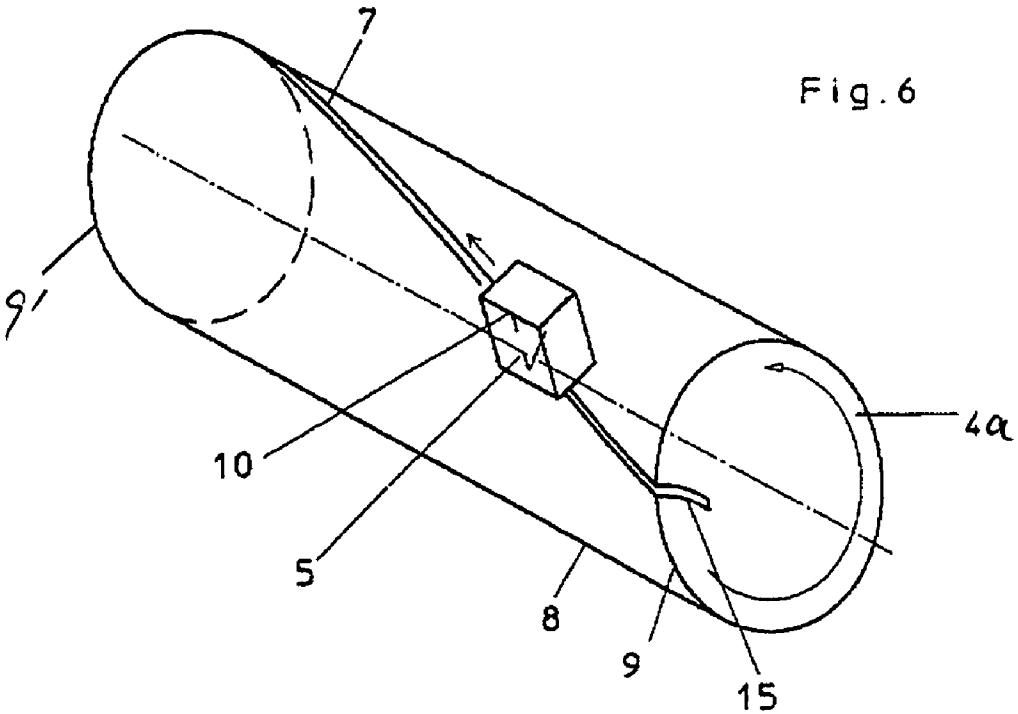
FIG. 6 shows the transporting roller from FIG. 5 in a diagrammatic representation and on an enlarged scale.

For cutting through the web of material 3 when the roll 6 has reached its intended size, a cutter holder 10 is provided with a cutter 5, which is guided in a groove 7, as can be seen from FIGS. 2, 4 and 6. The groove 7 runs from one edge 9 to the opposite edge 9' at an angle in relation to an axially parallel generatrix 8.

In its displacing movement from the edge 9 to the opposite edge 9' of the transporting roller 4, the cutter 5 with its cutter holder 10 must be synchronized with the circumferential speed of the transporting roller 4, that is to say the movement of the cutter is controlled in dependence on the circumferential speed of the transporting roller 4.

Represented in FIG. 2 is an embodiment of a transporting roller above which the cutter holder 10 is guided on a spindle 11, which is set in rotation by an electric spindle drive 12. The cutter holder 10 is, as it were, a movable nut on the spindle 11. An electric drive for the transporting roller 4 is denoted by 16 and the two drives 12 and 16 are synchronized by means of a control 13 in such a way that the cutter holder 10, and consequently the cutter 5, is controlled in its sequence of movements in the groove 7 in dependence on the circumferential speed of the transporting roller 4.

In the case of the embodiment that is shown in FIG. 4, the coupling between the cutter drive and the transporting roller drive is a gear mechanism in the form of a belt drive 14, which transmits the rotating movement of the transporting roller 4 to the spindle 11 by two belt pulleys 17 and 18 that support the belt drive 14, the diameter ratio of the two belt pulleys 17 and 18 being chosen such that the cutter 5 is moved in the groove 7 from the edge 9 to the opposite edge 9' of the transporting roller 4 when the transporting roller 4 has turned through the angular region enclosed by the two ends of the groove 7.

In the case of the exemplary embodiment that is shown in FIG. 6, the cutter 5 is guided by an edge of the groove 7, a catching device 15 being provided in transporting roller 4*a*, permitting introduction of the cutter 5 into the groove 7.

Figure 7:
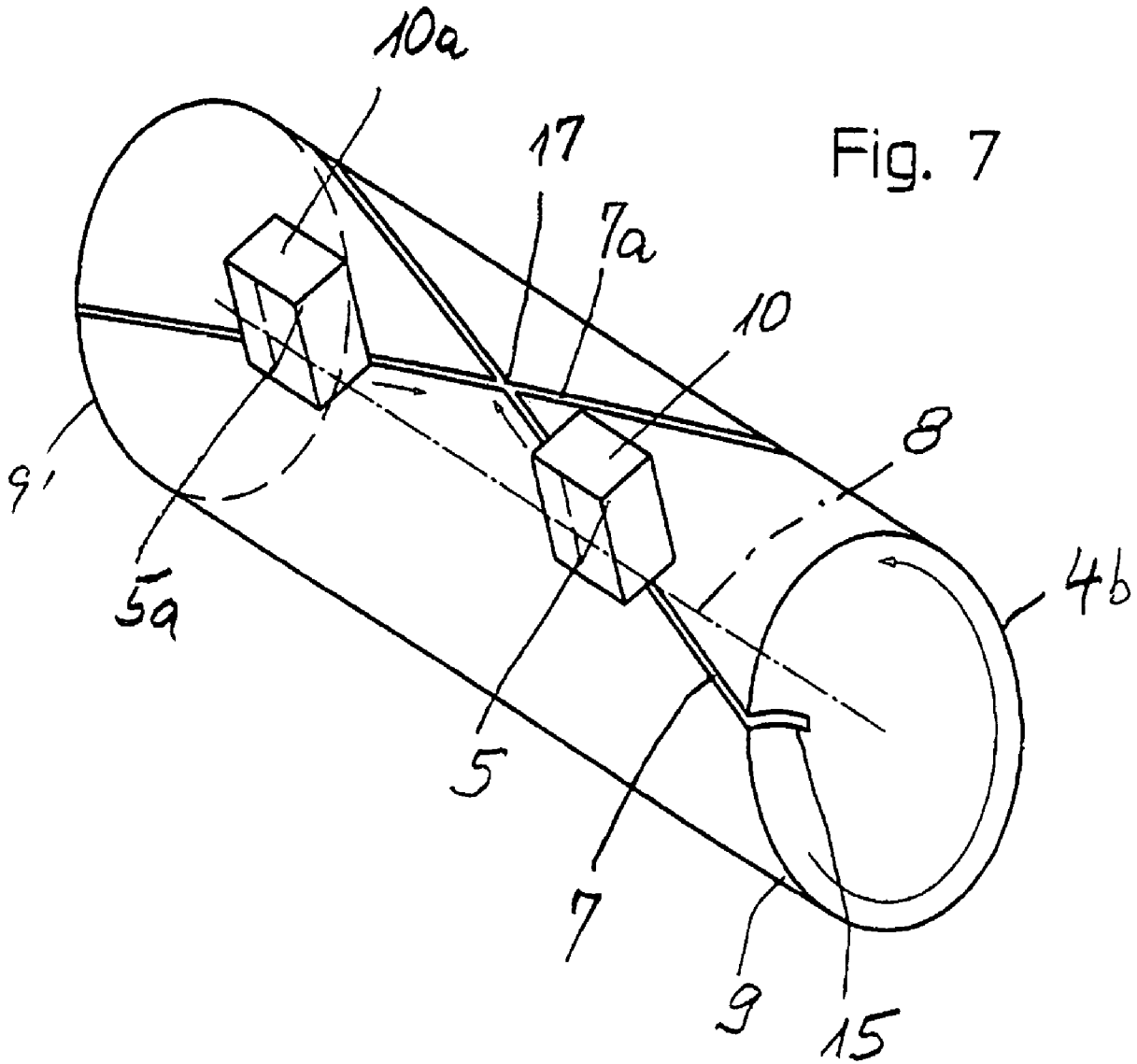
FIG. 7 shows a modified embodiment of the transporting roller of FIG. 6.

In the embodiment according to FIG. 7, the transporting roller 4*b* is provided with two grooves 7 and 7*a* for the guidance of two cutter holders 10 and 10*a* provided with respective cutters 5 and 5*a*. The grooves 7 and 7*a* exhibit a crossover point 17, which is equidistant from each of the axial ends of the roller 4. As shown in FIG. 7, the grooves can both run at the same angle to an axially parallel generatrix 8. As indicated by the arrows, the two cutter holders 10, 10*a* with the cutters 5, 5*a* run in opposite directions. The cutters can be driven independently of each other and can be propelled at the same or different speeds.

Figure 8:
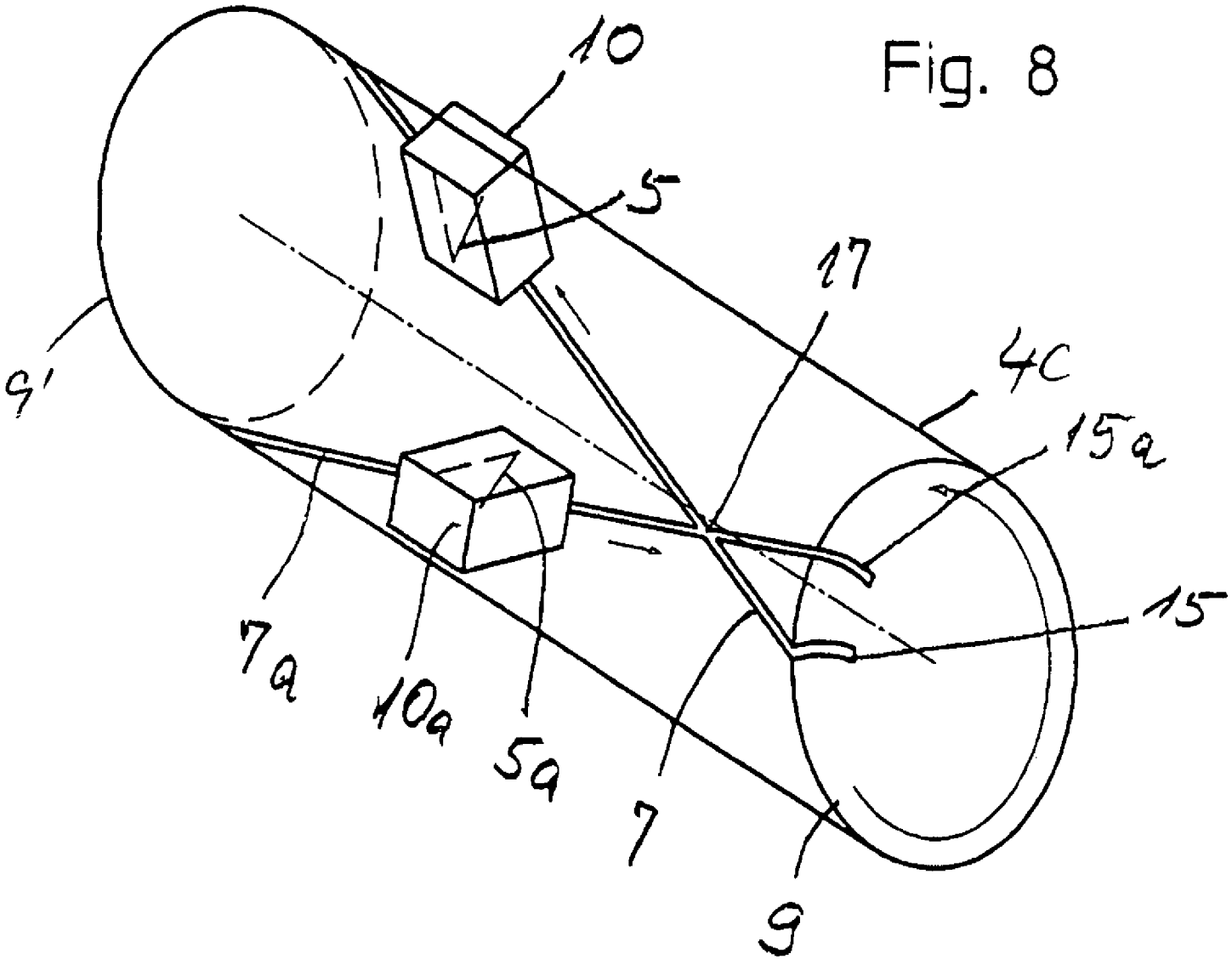
FIGS. 8 and 9 show variations of the arrangement of FIG. 7.

From FIG. 8 it is evident that the crossover point 17 is closer to the front end 9 of the transporting roller 4*c* than to the rear end 9'. In addition, the longer sections of the grooves 7 and 7*a* do not reach up to the rear end 9' of the roller, while the front sections reach up to the front end 9 of the transporting roller 4*c*, where respective safety stops 15 and 15*a* are provided.

Figure 9:
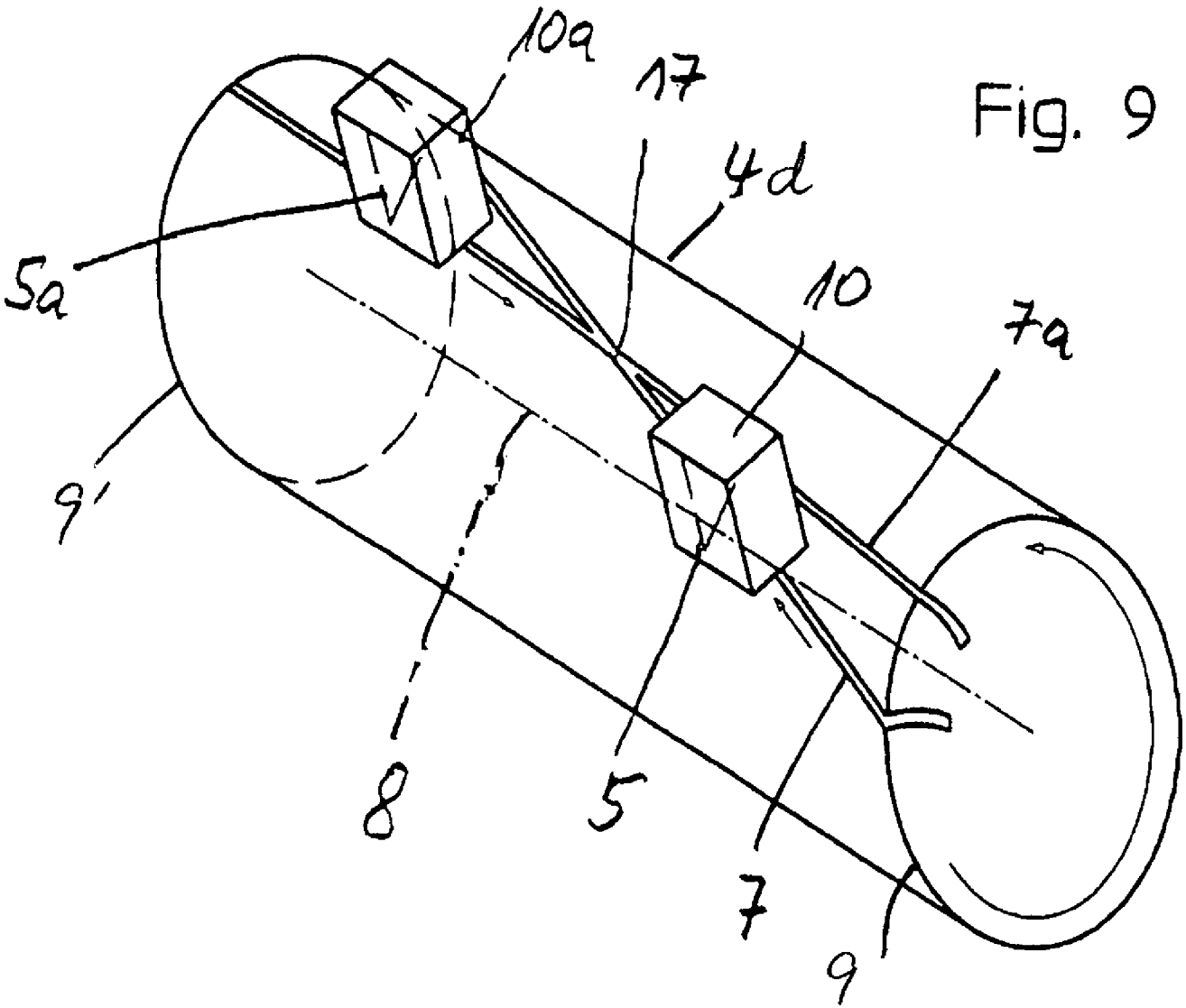

FIG. 9 shows in principle the same arrangement as in the FIGS. 7 and 8, however here the grooves 7 and 7*a* in transporting roller 4*d* exhibit different angles to the parallel generatrix 8. The crossover 17 of the two grooves 7 and 7*a* again lies for instance in the center between the two edges, as in FIG. 7. In all the embodiments according to FIGS. 7 to 9 the cutters with their cutter holders 10 and 10*a* are driven to move in opposite directions.

All embodiments permit the cutting of a web of material when the corresponding wound roll has been completed.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A cutting apparatus for cutting a moving web, the apparatus comprising:

a moving web transporting roller disposed in a web transporting path for cooperation with a moving web and supported for rotation about a longitudinal axis, the moving web transporting roller having a surface for supporting a web thereon, the surface defined by an axially parallel generatrix, the transporting roller further having a groove which intersects the surface and runs in a longitudinal direction at an angle to the axially parallel generatrix of the moving web transporting roller;

a cutting device having at least one cutter which is guided in the groove in the longitudinal direction of the groove, wherein a substantial portion of the cutting device is disposed outside of the transporting roller, and the cutter has a cutting portion that is aligned with and cooperates with the groove for cutting the web in a substantially axial direction; and means for controlling the movement of the cutter in dependence on a circumferential speed of the moving web transporting roller, wherein the groove extends from one axial end of the moving web transporting roller to the other axial end of the moving web transporting roller, and wherein the cutting device is supported such that it is movable parallel to the longitudinal axis of the transporting roller.

2. The cutting apparatus of claim 1, wherein the cutting device has only one cutter.

3. The cutting apparatus of claim 1, wherein the angle at which the groove runs is a constant angle to the axially parallel generatrix of the moving web transporting roller.

4. The cutting apparatus of claim 1, wherein the means for controlling the movement of the cutter comprises a belt drive device.

5. The cutting apparatus of claim 1, wherein the means for controlling the movement of the cutter comprises:

a drive for the moving web transporting roller;

a drive for the cutter; and a controller which couples the drive for the cutter to the drive for the moving web transporting roller.

6. The cutting apparatus of claim 1, wherein the groove has a lateral edge and a catching device at one end of the groove, the lateral edge of the groove driving the cutter in the manner of a motion-transmitting screw thread.

* * * * *